United States Patent [19]

Damour

[11] 4,204,619

[45] May 27, 1980

[54] PIVOTED WEB GUIDE FOR TRAVELLING STRIP

[76] Inventor: Lawrence R. Damour, 16 Chesler Sq., Succasunna, N.J. 07876

[21] Appl. No.: 902,844

[22] Filed: May 4, 1978

[51] Int. Cl.[2] ..... B65H 25/26

[52] U.S. Cl. ..... 226/21

[58] Field of Search ..... 226/21, 22, 23, 18, 226/15, 2, 3

[56] References Cited

U.S. PATENT DOCUMENTS

| | | | |
|---|---|---|---|
| 3,326,435 | 6/1967 | Shelton | 226/22 |
| 3,373,288 | 3/1968 | Otepka et al. | 226/21 X |
| 3,390,823 | 7/1968 | Ott, Jr. | 226/22 X |
| 3,581,963 | 6/1971 | Rule | 226/21 X |
| 3,599,849 | 8/1971 | Callan | 226/22 |
| 3,682,362 | 8/1972 | Ott, Jr. | 226/21 |
| 3,724,732 | 4/1973 | Bonner | 226/21 |
| 4,069,959 | 1/1978 | Bartell et al. | 226/21 |

*Primary Examiner*—Stanley N. Gilreath
*Attorney, Agent, or Firm*—Ralph R. Roberts

[57] ABSTRACT

This invention pertains to a web guide apparatus having a pivoted frame upon which are mounted parallel, constant diameter rollers. This frame is pivotally secured at one end near a roller and is moved around this pivot by an actuating mechanism such as an air or hydraulic cylinder or by a reversing motor. This movable frame is supported for a pivotal motion by a plurality of stanchions secured to a support plate frame. Each stantion has an upper and a lower ball caster or support. These balls have a specific apart spacing into which a hardened steel plate segment extends as carried by the pivoted frame. This pivoted frame and the parallel rollers fixed thereto are moved by a motor or cylinder means in accordance with edge sensing means.

9 Claims, 9 Drawing Figures

PIVOTED WEB GUIDE FOR TRAVELLING STRIP

DESCRIPTION OF THE PRIOR ART

The problem of guiding travelling webs is as old as treating and winding web material on rolls. As the speed and complexity of treating webs increased, so also did the necessity of guiding webs in a straight path. Manual guiding has been employed as well as curved rollers for automatic positioning. Stretching of the web material is an unwanted result of using some of the automatic equipment of recent design and development.

Stretching is a particular problem when the continuous travelling web is paper, plastic film or the like. In the processing of such thin travelling webs it is necessary or at least highly desirable that the web be maintained in proper registry with the machine that provides an operation on the web. When misalignment does occur it has to be corrected as rapidly as possible so as to avoid wastage or stretching. In particular, the travelling webs may have a high content of plastic or rubber-like composition. This web may be paper which may be treated or may be cured with rubber or resin and requires an accurate registration of the web for the processing of this web at or before final use.

It is known to use web guide apparatus which includes a stationary support frame attached to a floor or a machine associated structure. A movable frame is mounted on this support frame and this movable frame is steered by appropriate apparatus such as an air cylinder or an electric reversing motor. This movable frame normally includes a mounted pair of like-spaced parallel rollers which are moved with an edge reading means by a conventional mechanical device. This movable or steering frame is pivoted to move the mounted pair of rollers to guide the web and reposition it laterally as it moves along and over the two mounted guide rollers. These two rollers are normally used in a web threading position which may be a horizontal or a vertical U-threading position. Alternate web guide portions may include a horizontal Z-threading position or a vertical Z-threading position. Many systems have been utilized for web guide apparatus and included are U.S. Pat. No. 3,390,823 as well as U.S. Pat. No. 3,326,435. Also of note are U.S. Pat. No. 3,581,963; U.S. Pat. No. 3,724,732 and the recently issued U.S. Pat. No. 4,069,959. In these examples of web guide apparatus it is to be noted that although the movable frame is pivoted, the actuation and support employs arcuate guides and/or ball bushing-type bearings. These arrangements are expensive and prone to damage. Some of these guide systems are formed with arcuate bearings as well as arcuate guide bars and both add considerably to the cost and complexity of the web guide apparatus. Multiple frame supports are found in the reference patents and are expensive or do not provide the stability of operation desired.

In the present invention a simple pivot construction is employed at one end of the movable frame upon which is carried the parallel rollers. This frame is supported by ball casters which engage opposite sides of a simply constructed flat stock plate. These casters provide the support for the pivoted frame in an economical and foolproof manner.

SUMMARY OF THE INVENTION

This invention may be summarized at least in part with reference to its objects.

It is an object of this invention to provide, and it does provide, an improved web guide apparatus in which the movable frame is pivotally secured at one end adjacent or very near to one of the supported parallel arranged rollers carried by this frame.

It is another object of this invention to provide, and it does provide, a web guide apparatus in which the steering frame is supported by four pairs of ball casters which engage flat bar members carried by the pivoted frame. These ball casters or rollers are attached and supported by stanchions attached to the fixed frame. These ball rollers as opposed pairs engage upper and lower planar extents of a guide bar which is secured to the pivoted frame.

Briefly, the web guide and carrying apparatus, to be more fully descripted hereinafter, includes a steering frame on which is mounted a pair of rollers and over which passes the travelling web to be guided. This pivotally mounted frame is supported and movable in relation to a stationary support frame. The steering frame is pivotally secured at a pivot point either near to or underneath one of the parallel rollers carried by the movable, pivotal frame. This pivoted steering frame is supported by the fixed support frame and includes a plurality of ball-type casters or bearings. These ball casters are positioned above and below a flat bar members secured to and carried by the pivoted frame. These ball caster supports induce little friction and provide a positive support as well as prevent the pivoted frame from moving contrary in other than a plane as established by the positioning of the balls as carried by the support stanchions. The pivoted frame is moved by a mechanical means such as a hydraulic or air cylinder or a reversing electric motor. This means is responsive to a sensing device such as an electric eye. The placing of the pivot near one end of the movable frame allows a precise tracking with a minimal extent of swing.

The ball caster or bearing supports are located at four points to support the movable frame and provide minimum structural deformation of the steering or movable frame. This arrangement minimizes the effort required to move the pivoted frame without sacrificing web guide and positioning accuracy.

In addition to the above summary the following disclosure is detailed to insure adequacy and aid in understanding of the invention. This disclosure, however, is not intended to cover each new inventive concept therein no matter how it may later be disguised by variations in form or additions of further improvements. For this reason there has been chosen a specific embodiment of the web guide apparatus as adopted for use in travelling webs and showing a preferred means for pivotally mounting and supporting this frame with ball casters. This specific embodiment has been chosen for the purpose of illustration and description as shown in the accompanying drawings wherein:

Figure 5:
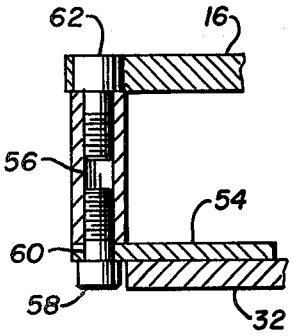
FIG. 5 represents a sectional view of the pivot means by which the movable frame is pivotally secured, this view taken on the line 5—5 of FIG. 3 and looking in the direction of the arrows.

The important features and advantages of the invention will be understood from the following detailed description taken in conjunction with the accompanying drawings in which various details are identified by specific names for convenience, these names, however, are intended to be generic in their application. Corresponding reference characters refer to like members throughout the several figures of the drawings.

The drawings accompanying and forming a part of this application disclose certain details of construction for the purpose of explanation of the broader aspects of the invention, but it should be understood that structural details may be modified in various respects and that the invention may be incorporated in other structural forms than shown.

WEB GUIDE ARRANGEMENT

As in FIGS. 1A, 1B, 1C and 1D

Figure 1A:
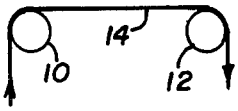
FIG. 1A represents a diagram of the two rollers carried on the pivoted frame and arranged for a horizontal U-thread operation.
Figure 1B:
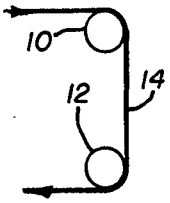
FIG. 1B represents a diagram as in FIG. 1A but with the pivoted frame and supported rollers arranged for a vertical U-thread operation.
Figure 1C:
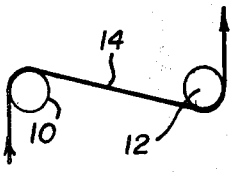
FIG. 1C represents a diagram as in FIG. 1A but with the frame and rollers arranged for a horizontal Z-thread operation.
Figure 1D:
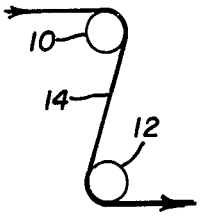
FIG. 1D represents a diagram as in FIG. 1A but with the frame and rollers arranged for a vertical Z-thread operation.

Referring now to FIGS. 1A, 1B, 1C and 1D it is to be noted that a diagrammatic showing is made of four of the arrangements whereby like freely turning rollers 10 and 12 are arranged and adapted to carry and direct a travelling web 14. In FIG. 1A is shown the travelling web going over rollers 10 and 12 arranged for a horizontal U-threading of the travelling web 14. In FIG. 1B is shown the same rollers 10 and 12 arranged in a vertical manner with a U-threading of the web 14 with the web approaching from the top left and thence moving downwardly and then to the right of roller 12 and thence on the bottom extent left. In FIG. 1C is shown rollers 10 and 12 arranged to provide a horizontal Z-threading pattern whereby the film 14 comes from the left around roller 10 thence downwardly to roller 12 where it passes underneath and thence upwardly around roller 12, as shown in the diagram. In FIG. 1D a vertical Z-thread has the rollers 10 and 12 arranged in a vertical manner so that the film 14 approaches from the left around the roller 10 and thence downwardly and to the right and thence around roller 12 and thence to the right.

Although the web guide shown in FIGS. 1A, 1B, 1C and 1D are in horizontal and vertical attitudes, it is to be noted that the rollers 10 and 12 and the travelling web 14 may be disposed in any desired arrangement and the two rollers 10 and 12 are moved as a unit to provide the web correction desired.

Figure 2:
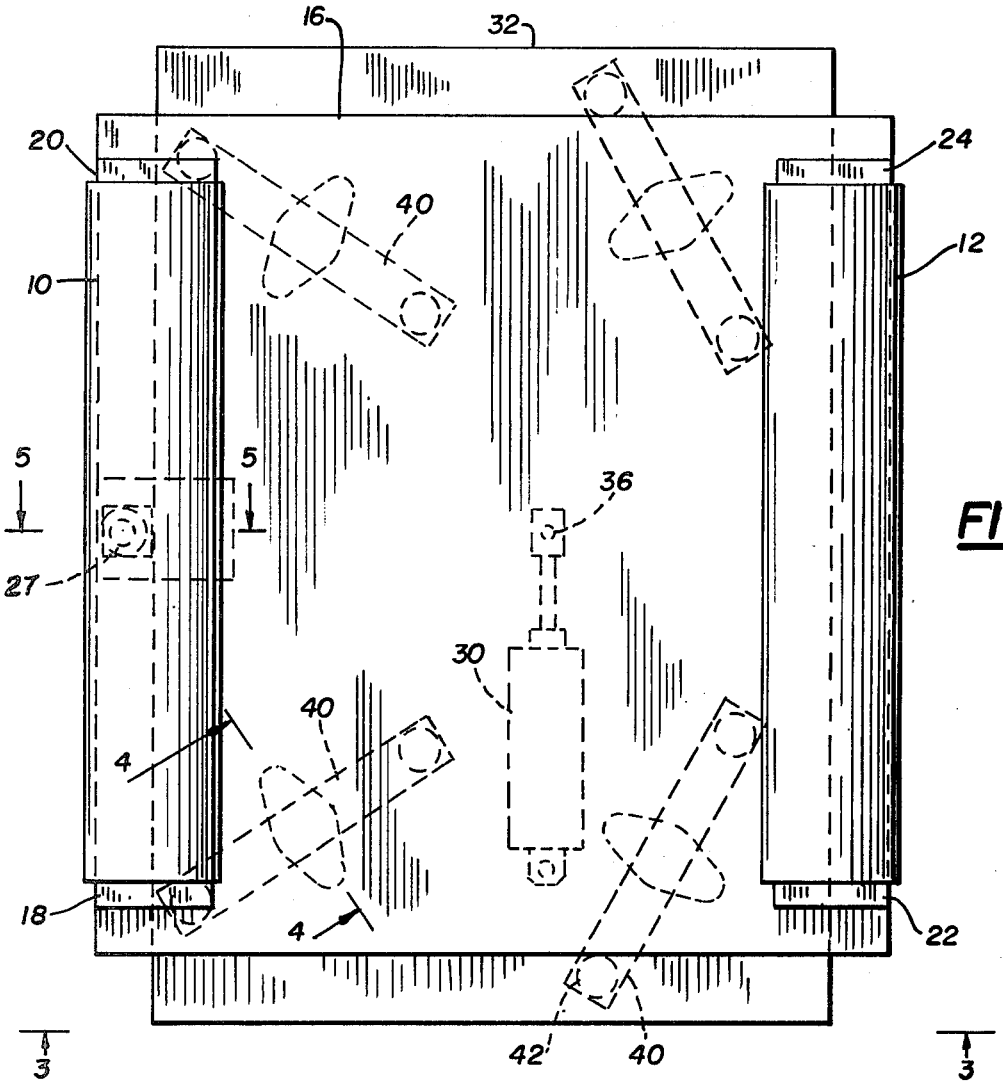
FIG. 2 represents a top view of the travelling web guide apparatus with the pivot pin, the movable frame supports and the adjusting mechanism shown in dotted outline.
Figure 3:
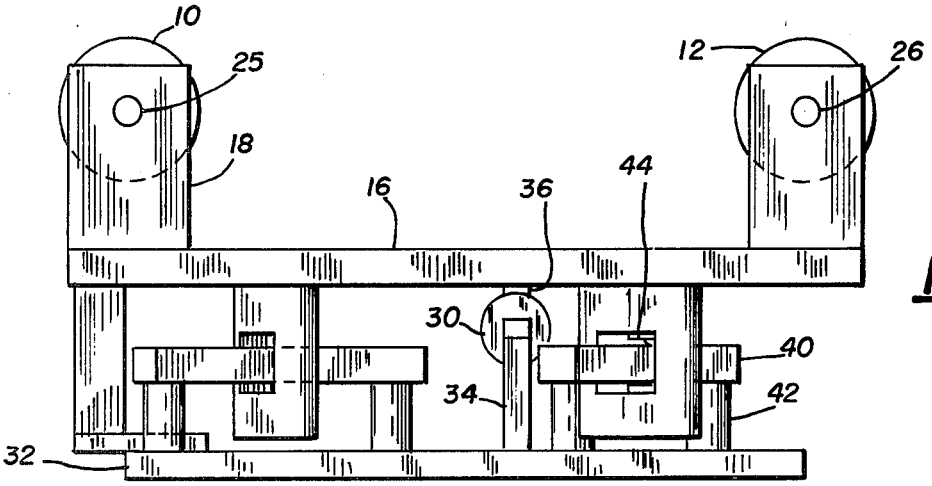
FIG. 3 represents a side view of the travelling web guide apparatus of FIG. 2, this view taken on the line 3—3 and locking in the direction of the arrows.

Apparatus as Seen in FIGS. 2 and 3

Referring next to FIGS. 2 and 3 it is to be noted that the travelling web guide apparatus includes a movable support plate 16 upon which is carried the rollers 10 and 12 in a parallel arrangement. Plate 16 is preferably a solid member with no intermediate cutouts and is conventionally shown as rectangular in configuration. End support members 18 and 20 are secured to this plate either by bolting or welding and carry shaft 25 upon which roller 10 is secured. Bearings for making roller 10 free turning may be carried either in said roller or in the support members 18 and 20. In any case, the roller 10 is secured to plate 16 and is free turning. Roller 12 is also carried by plate 16 by means of end members 22 and 24. Shaft 26 passes through both end members 22 and 24 and the roller 12. The shaft is mounted in bearings either in members 22 and 24 or in bearings mounted in roller 12. In any event, the shaft is secured in end members 22 and 24.

Substantially at the center line or axis of the plate 12 and the roller 10 is a plate pivot pin assembly generally identified as 27. This pivot pin assembly is more fully seen in the sectional view taken in conjunction with FIG. 5. It is anticipated that the pivoted support or movable plate 16 may be moved about one-inch either to the left or to the right of the nominal center line. Each roller 10 and 12 is anticipated to be about ten inches in nominal length and about two inches in diameter. The spacing between rollers 10 and 12 is approximately ten inches between the shafts 25 and 26. Air or hydraulic cylinder 30 is secured to the underside of plate 16 and moves this plate in response to an actuation or signal mormally derived from the edge of the travelling web of material 14. A bottom plate 32 carries the post support 34 by which the clevis end of the cylinder 30 is attached. The movable plate 16 carries and pivotally retains pin 36 by which the piston rod end of the cylinder 30 is secured and moves plate 16. Four like flat bar members 40 are secured by posts 42 to the bottom plate 32. Ball casters 44 are disposed above and below the flat bar members 40 in a manner to be more fully described below in conjunction with FIG. 4.

Figure 4:
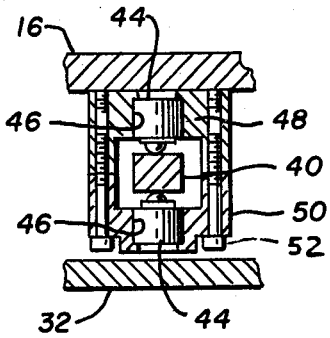
FIG. 4 represents a sectional view of a movable frame ball support apparatus, this view taken on the line 4—4 of FIG. 2 and looking in the direction of the arrows.

Ball Caster Support as Shown in FIG. 4

Referring next and now in particular to FIG. 4 in which there is shown a preferred support for the movable plate 16. Ball casters or transfers 44 are conventional and, as reduced to practice, are about one-half inch diameter. These ball transfers are carried in a recess 46 as formed in an upper mounting block 48 which is secured to the movable frame 16. A lower housing 50 also has a recess 46 formed therein for the seating of a ball caster on transfer 44. Lower housing 50 is secured to the housing 48 by means of cap screws 52. It is to be noted that there is a small clearance between the lower extremity of the housing 50 and the lower fixed plate 32 so that ball transfer 44 is freely movable along the flat bar member 40.

Preferably these flat bar members are made of steel with a hardened surface or are through hardened so as to withstand a certain amount of continual movement. Four of these ball transfer assemblies are provided. Two are near the roller 10 and two are close to the other roller 12. Each of these flat bar members 40 are arranged so that they provide like surfaces upon which and over which the ball transfers may move for the degree of arcuate movement necessary to provide the web guide movement.

Pivoted Means as in FIG. 5

Referring next to FIG. 5 it is to be noted that means for pivoting the upper plate is provided by this apparatus. On the lower plate 32 is fastened a tongue member 54 which provides the lower support for a post 56. A cap screw 58 passes through a hole 60 formed in tongue member 54 and secures post 56 thereto. A McGill cam roll bearing 62 is positioned in place and carries and provides a roller bearing pivot for the upper movable plate 16.

Figure 6:
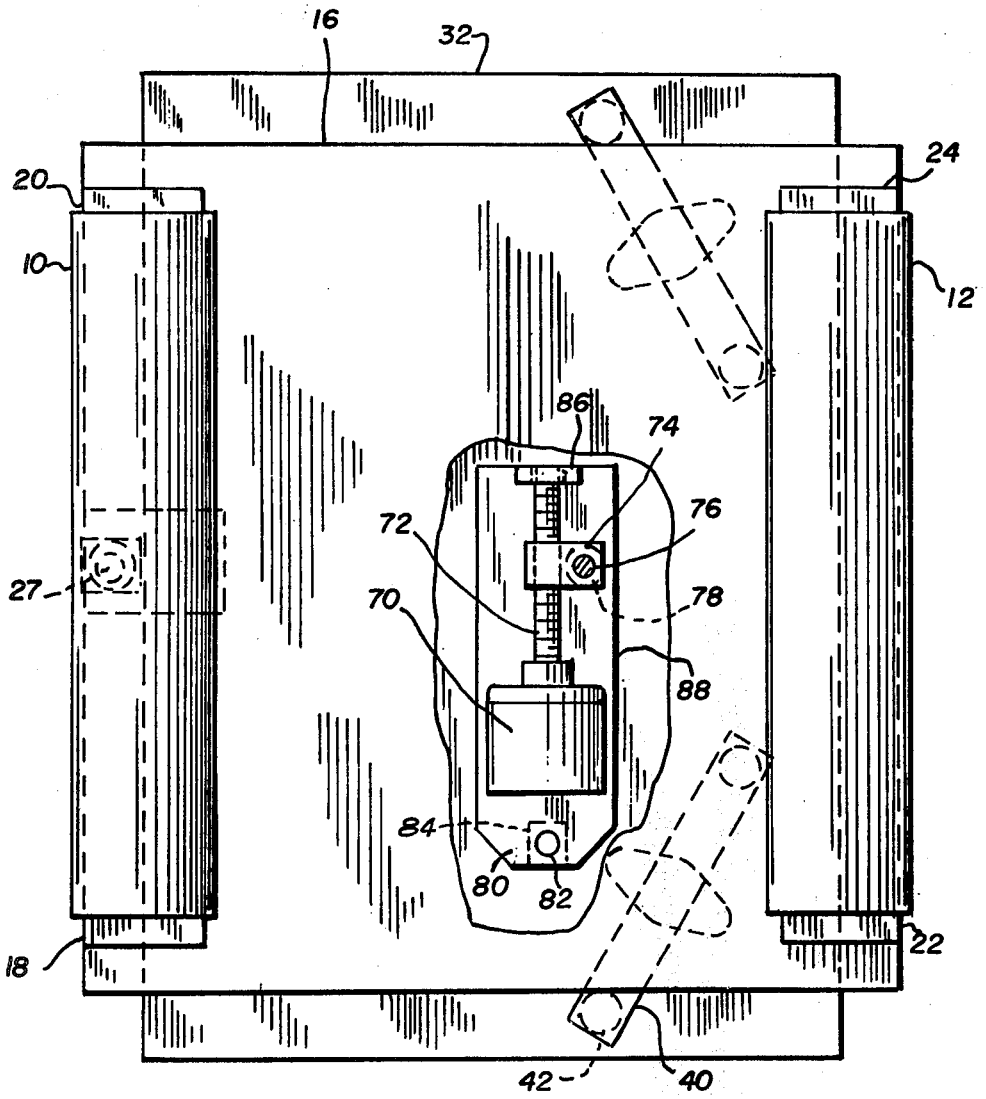
FIG. 6 represents a top view of the traveling web guide apparatus as in FIG. 2 but arranged with a three point suspension and with a portion broken away to show a drive by a reversing electric motor and a screw.

Alternate Embodiment of FIG. 6

Referring next and finally to FIG. 6 there is shown a plan view in which only a three-point suspension is provided. This arrangement is used when the guided film is light or narrow or both. The left end supports 42 and the flat bar members 40 are not used in this embodiment. The front pivot 27 or the extended pivot as shown in FIG. 5 may be used in this three-point embodiment. Also shown in FIG. 6 is a representation of an alternate means for moving plate 16. An electric D.C. or reversable gear motor 70 has a threaded screw shaft 72 which moves and turns in a nut 74. This nut is pivotally carried by a pin 76 which is carried by and secured to a post 78 shown in dashed outline and secured to the top plate 16 to move this plate in response to signals sent to the motor 70. This gear motor at its rear end is also pivotally retained by a pivot 80, a pin 82 and a support 84 or conventional arrangement. This gear motor can also be supported so that the nut 74 is moved to compensate for or accommodate the arc movement of the plate 16 around the pivot 27 or 62. An outboard support 86 may be provided to carry the outer or unsupported end of screw 72. The motor 70 and the outboard support 86 may be carried on a pivoted support plate 88 for ease of assembly and alignment. A D.C. motor 70 may be provided and the screw 72 and nut 74 may use the conventional ball screw and nut. The selection of a motor and screw is merely a matter of choice.

The above web guiding apparatus although shown and described with attention to a given size is provided and contemplated to be used in many sizes. The user of this web guide often provides all the travelling web apparatus and rollers except for the web guide apparatus which, as shown, includes only the two parallel rollers carried on the movable frame. The pivot pin above-identified is mentioned as a McGill cam roller. This is made by the McGill Mfg. Company, Valpairaiso, Indiana but like apparatus is commercially available from many other manufacturers of roller-type bearings. The ball transfers, particularly shown in FIG. 4 above, come in many sizes and are commercially available from many sources. The ball transfers above-identified are available from Genbearco International Corp., West Nyack, New York and are, of course, available from many other manufacturing sources.

It is also to be noted that FIG. 4 shows the ball transfers as secured to and carried in stanchions bolted to the movable plate 16. The flat bar member 40 is carried by posts 42 secured to the fixed frame 32. This arrangement can be reversed either in part or completely. That is to say, that flat bar members 40 may be carried by the movable frame on plate 16 and then the ball transfers 46 in stanchion portions 48 and 50 would be secured to the fixed frame 32. In a like manner in FIG. 5 the tongue 54 and post 56 are fastened to the fixed frame 32. This arrangement of an antifriction pivot can be reversed, if desired.

It is to be noted that in FIG. 6 a pivoted plate 16 having a three point supported member has a shoulder or extension made at the antifriction pivot pin. The ball transfers of FIG. 4 in a three point suspension as shown in FIG. 6 are near roller 12. Other arrangements of ball transfers and flat bar members 40 are possible.

The web guiding apparatus shown and described above is of a small size for a narrow web requiring less than two inches alignment of the travelling web. Wider webs are, of course, contemplated. Webs of ninety inches in width are accommodated with this arrangement of guide apparatus. The rollers for such webs are more than ninety inches wide and the diameters also are increased, as for example, eight inches in diameter. The amount of swing for alignment is of a degree to suit the web being transported. The diameter of the rollers is also selected to suit the material of which the web is made.

It is also to be noted that at eighteen inches and more in width both the movable plate or frame 16 and the support member 32 are heavy and a solid movable plate provides quite an inertia problem. For economy, weight and handling ability these members are made as frames and often of tubing. In many cases where large and long pulleys are used plural ball transfers above and below the plates 40 bear the weight and load thrust of the guide apparatus.

The web guide is made to suit the particular web being transported. The rollers are sized both as to diameter and length and the frames are made to suit. The swing of the frame is established by the deviation of the web from a desired path. The ball rollers provide minimum friction on the support bars whether one or more ball rollers are disposed on each side of the bar.

Terms such as "left", "right", "up", "down", "bottom", "top", "front", "back", "in", "out" and the like are applicable to the embodiment shown and described in conjunction with the drawings. These terms are merely for the purpose of description and do not necessarily apply to the position in which the web guide apparatus may be constructed or used.

While a particular embodiment of said web guide apparatus and method have been shown and described it is to be understood the invention is not limited thereto since modifications may be made within the scope of the accompanying claims and protection is sought to the broadest extent the prior art allows.

What is claimed is:

1. Apparatus for laterally guiding a travelling web of material which includes: (a) a support frame adapted for securing in a desired attitude to a machine or base; (b) a movable frame pivotally attached to the support frame and carried in a spaced relationship to the support frame, said frame movable in and to a determined limited extent; (c) a pivot post disposed at one end of the support frame and movable frame, this pivot post secured to one of the frames and carrying an antifriction pivot unit which engages and is secured in the other frame so that the movable frame is easily moved around the axis of this pivot unit with relation to the fixed frame; (d) a plurality of stanchions carried by and secured to one of the frames, each stanchion having mounted therein and thereon opposed ball transfer devices, these opposed ball transfers being adjusted so as to provide a determined spacing therebetween and at an established distance from the attaching surface of the stanchion; (e) a plurality of flat bar members each having parallel faces, each bar secured to that frame not carrying the stanchions, each bar so secured as to present the parallel faces of the bar in a plane normal to the axis of the pivot, each of said bars so positioned that the parallel faces when brought between the ball transfers are engaged on both faces by the ball portions of the opposed ball transfers during the limited movement of the movable frame; (f) a pair of free turning rollers carried in parallel relationship on said movable frame, and (g) mechanically responsive means for moving and controlling the angular position of said pivoted frame, said means responsive to an edge positioning sensing of the travelling web.

2. Apparatus for laterally guiding web material as in claim 1 in which the mechanically responsive means is an air cylinder.

3. Apparatus for laterally guiding web material as in claim 1 in which the mechanically responsive means is an hydraulic cylinder.

4. Apparatus for laterally guiding web material as in claim 1 in which the mechanically responsive means is a reversing electric motor which turns a screw in a nut member pivotally secured to the movable frame.

5. Apparatus for laterally guiding web material as in claim 1 in which said pivot post is carried on a tongue secured to the fixed support frame and in said post is carried a roller bearing cam follower which pivotally supports the movable frame.

6. Apparatus for laterally guiding web material as in claim 5 in which the pivot pin which is located at one end of the movable frame is at or beyond the axis of one roller and away from the other roller as carried on the movable frame.

7. Apparatus for laterally guiding web material as in claim 1 in which there are four stanchions, each fastened to the movable frame and there are four associated flat bars carried by the fixed frame in a selected attitude.

8. Apparatus for laterally guiding web material as in claim 1 in which stanchions and flat bars are disposed on that portion of the fixed support and associated movable frame that is between the pair of free turning rollers as carried by and on the movable frame.

9. Apparatus for laterally guiding web material as in claim 1 in which there are two stanchions carried by one of the frames and two bars carried by the other frame, the bars and stanchions arranged in a cooperative relationship and positioned substantially equidistant from the pivot pin to provide a three point suspension with the pivot pin of the movable frame.

* * * * *